US008139773B2

(12) United States Patent
Oh et al.

(10) Patent No.: US 8,139,773 B2
(45) Date of Patent: Mar. 20, 2012

(54) METHOD AND AN APPARATUS FOR DECODING AN AUDIO SIGNAL

(75) Inventors: Hyen-O Oh, Seoul (KR); Yang Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 199 days.

(21) Appl. No.: 12/695,776

(22) Filed: Jan. 28, 2010

(65) Prior Publication Data

US 2010/0202620 A1 Aug. 12, 2010

Related U.S. Application Data

(60) Provisional application No. 61/148,047, filed on Jan. 28, 2009, provisional application No. 61/150,303, filed on Feb. 5, 2009, provisional application No. 61/153,947, filed on Feb. 19, 2009.

(30) Foreign Application Priority Data

Jan. 27, 2010 (KR) ..... 10-2010-0007633

(51) Int. Cl.
*H04R 5/00* (2006.01)
*G10L 19/00* (2006.01)

(52) U.S. Cl. ..... 381/17; 704/500

(58) Field of Classification Search ..... 381/17, 381/1; 704/500, 501
See application file for complete search history.

(56) References Cited

U.S. PATENT DOCUMENTS

| | | | | |
|---|---|---|---|---|
| 7,987,096 | B2 * | 7/2011 | Kim et al. | 704/500 |
| 2008/0002842 | A1 * | 1/2008 | Neusinger et al. | 381/119 |
| 2008/0130904 | A1 * | 6/2008 | Faller | 381/17 |
| 2008/0140426 | A1 | 6/2008 | Kim et al. | |
| 2008/0205657 | A1 | 8/2008 | Oh et al. | |
| 2008/0269929 | A1 | 10/2008 | Oh et al. | |
| 2009/0006106 | A1 | 1/2009 | Pang et al. | |
| 2010/0094631 | A1 * | 4/2010 | Engdegard et al. | 704/258 |
| 2010/0174548 | A1 * | 7/2010 | Beack et al. | 704/503 |
| 2011/0085669 | A1 * | 4/2011 | Jung et al. | 381/2 |
| 2011/0091046 | A1 * | 4/2011 | Villemoes | 381/22 |
| 2011/0173005 | A1 * | 7/2011 | Hilpert et al. | 704/500 |
| 2011/0200196 | A1 * | 8/2011 | Disch et al. | 381/22 |
| 2011/0200197 | A1 * | 8/2011 | Kim et al. | 381/22 |

* cited by examiner

*Primary Examiner* — Hai Phan
(74) *Attorney, Agent, or Firm* — Birch, Stewart, Kolasch & Birch, LLP

(57) ABSTRACT

An apparatus and method for receiving a downmix signal including at least one object signal, and a bitstream including object information and downmix channel level difference. When the downmix signal includes at least two object signals, a relation identifier indicating whether two object signals are related is extracted, and whether the two object signals correspond to stereo object signals is identified using the downmix channel level difference and the relation identifier generating mix information including a first element and a second element using a single user input, and generating at least one of downmix processing information and multichannel information based on the object information and the mix information. Further, the first element is applied to the left object signal to output a first channel, the second element is applied to the right object signal to output a second channel, and the first element is conversely related to the second element.

14 Claims, 13 Drawing Sheets

(a)

(b)

(a) (b)

(a)

(b)

METHOD AND AN APPARATUS FOR DECODING AN AUDIO SIGNAL

CROSS-REFERENCE TO RELATED APPLICATIONS

This application claims the benefit of priority to U.S. Provisional Application No. 61/148,047, filed on Jan. 28, 2009, U.S. Provisional Application No. 61/150,303, filed on Feb. 5, 2009, U.S. Provisional Application No. 61/153,947, filed on Feb. 19, 2009 and Korean application No. 10-2010-0007633, filed on Jan. 27, 2010, the contents of which are incorporated by reference herein in their entirety.

FIELD OF THE INVENTION

The present invention relates to an apparatus for processing an audio signal and method thereof. Although the present invention is suitable for a wide scope of applications, it is particularly suitable for processing audio signals received via a digital medium, a broadcast signal and the like.

BACKGROUND ART

Generally, in the process for downmixing an audio signal including a plurality of objects into a mono or stereo signal, parameters are extracted from the objects. These parameters are usable in decoding a downmixed signal. And, a panning and gain of each of the objects are controllable by a selection made by a user as well as the parameters.

First of all, a panning and gain of objects included in a downmix signal can be controlled by a selection made by a user. However, in case that a user controls objects, it is inconvenient for the user to directly control all object signals. Compared to a case of control by an expert, it may be difficult to reproduce an optimal state of an audio signal including a plurality of objects.

Secondly, in case that a user adjusts pannings and gains of objects, it is necessary to determine whether an output signal is a stereo object signal. If the output signal is the stereo object signal, the stereo object signal should be controlled using one user input.

SUMMARY OF THE INVENTION

Accordingly, the present invention is directed to an apparatus for processing an audio signal and method thereof that substantially obviate one or more of the problems due to limitations and disadvantages of the related art.

An object of the present invention is to provide an apparatus for processing an audio signal and method thereof, by which whether a downmix signal is a stereo object signal can be identified using a relation identifier and downmix channel level difference information.

Another object of the present invention is to provide an apparatus for processing an audio signal and method thereof, by which pannings and gains of objects can be controlled based on selections made by a user.

A further object of the present invention is to provide an apparatus for processing an audio signal and method thereof, by which, in controlling pannings and gains of objects based on selections made by a user, of an output signal is a stereo object signal, a panning and gain of object can be controlled using one user input.

Accordingly, the present invention provides the following effects and/or advantages.

First of all, the present invention is able to identify whether an output signal is a stereo object signal using a relation identifier and a DCLD.

Secondly, the present invention is able to control gains and pannings of objects based on selections made by a user.

Thirdly, when gains and pannings of objects are controlled, if an output signal is a stereo object signal, the present invention is able to control a panning and gain of an object using one user input.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DESCRIPTION OF EMBODIMENTS OF THE PRESENT INVENTION

Figure 1:
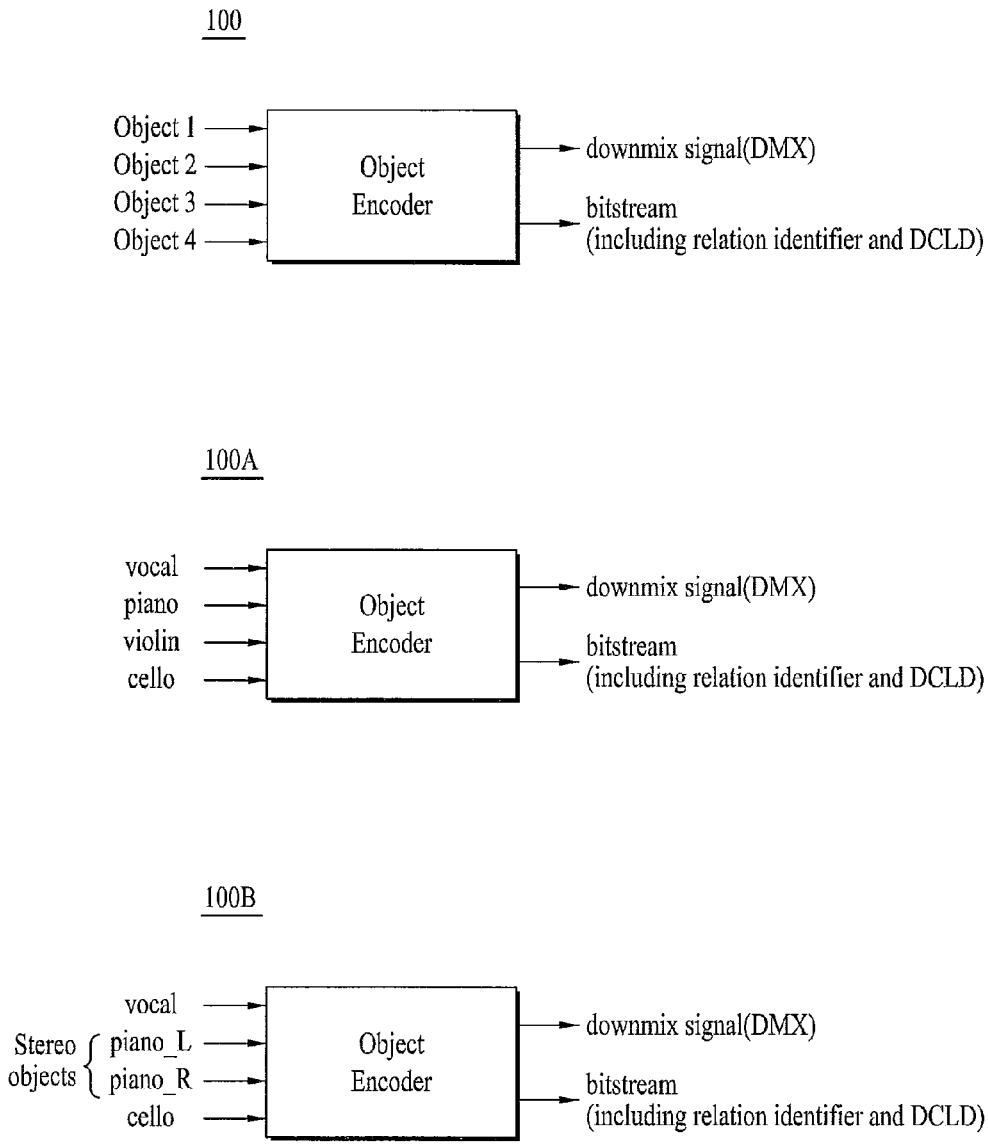
FIG. 1 is a diagram of an object encoder according to one embodiment of the present invention.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a method for processing an audio signal, includes the steps of receiving a downmix signal comprising at least one object signal, and a bitstream including object information and downmix channel level difference, when the downmix signal comprises at least two object signals, extracting a relation identifier from the bitstream, the relation identifier indicating whether two object signals among the at least two object signals are related to each other, identifying whether the two object signals correspond to stereo object signals, using the downmix channel level difference and the relation identifier, generating mix information including a first element and a second element using a single user input, and generating at least one of downmix processing information and multi channel information based on the object information and the mix information, wherein the stereo object signals include a left object signal and a right object signal, the first element is applied to the left object signal of the stereo object signals to output a first channel, the second element is applied to the right object signal of the stereo object signals to output a second channel, and the first element is conversely related to the second element.

Preferably, the left object signal is mapped to a left channel of the downmix signal, and the right object signal is mapped to a right channel of the downmix signal.

Preferably, the identifying step comprises identifying whether two object signals among the at least two object signals are related to each other, based on the relation identifier, when two object signals are related to each other, identifying whether the downmix channel level difference of the two object signals has a maximum value or a minimum value, and when the downmix channel level difference of the two object signals has a maximum or a minimum value, deciding that the two object signals correspond to the stereo object signals.

Preferably, the first element and the second element are used to control the stereo object signals jointly.

Preferably, when the first element is larger, the second element is smaller, or when the first element is smaller, the second element is larger.

Preferably, the mix information further includes a third element and a fourth element, the third element is applied to a left object signal of the stereo object signals to output the second channel, and the fourth element is applied to a right object signal of the stereo object signals to output the first channel, wherein the third element and fourth element are zero.

Preferably, the method further includes the steps of processing the downmix signal using the downmix processing information, and, generating a multi-channel signal based on the processed downmix signal and the multi-channel information.

To further achieve these and other advantages and in accordance with the purpose of the present invention, an apparatus for processing an audio signal comprises a receiving unit receiving a downmix signal comprising at least one object signal, and a bitstream including object information and downmix channel level difference, when the downmix signal comprises at least two object signals, extracting a relation identifier from the bitstream, the relation identifier indicating whether two object signals among the at least two object signals are related to each other, an identifying unit identifying whether the two object signals correspond to stereo object signals, using the downmix channel level difference and the relation identifier, a mix information generating unit generating mix information including a first element and a second element using a single user input, and an information generating unit generating at least one of downmix processing information and multi channel information based on the object information and the mix information, wherein the stereo object signals include a left object signal and a right object signal, the first element is applied to the left object signal of the stereo object signals to output a first channel, the second element is applied to the right object signal of the stereo object signals to output a second channel, and the first element is conversely related to the second element.

Preferably, the left object signal is mapped to a left channel and the right object signal is mapped to a right channel.

Preferably, the identifying unit is configured to identify whether two object signals among the at least two object signals are related to each other, based on the relation identifier, when two object signals are related to each other, identify whether the downmix channel level difference of the two object signals has a maximum value or a minimum value, and when the downmix channel level difference of the two object signals has a maximum or a minimum value, decide that the two object signals correspond to the stereo object signals.

Preferably, the first element and the second element are used to control the stereo object signals jointly.

Preferably, when the first element is larger, the second element is smaller, or when the first element is smaller, the second element is larger.

Preferably, the mix information further includes a third element and a fourth element, the third element is applied to a left object signal of the stereo object signals to output the second channel, and the fourth element is applied to a right object signal of the stereo object signals to output the first channel, wherein the third element and fourth element are zero.

Preferably, the apparatus further includes a downmix processing unit processing the downmix signal using the downmix processing information, and a multi-channel decoder generating a multi-channel signal based on the processed downmix signal and the multi-channel information.

It is to be understood that both the foregoing general description and the following detailed description are exemplary and explanatory and are intended to provide further explanation of the invention as claimed.

Reference will now be made in detail to the preferred embodiments of the present invention, examples of which are illustrated in the accompanying drawings. First of all, terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's invention in best way. The embodiment disclosed in this disclosure and configurations shown in the accompanying drawings are just one preferred embodiment and do not represent all technical idea of the present invention. Therefore, it is understood that the present invention covers the modifications and variations of this invention provided they come within the scope of the appended claims and their equivalents at the timing point of filing this application.

The following terminologies in the present invention can be construed based on the following criteria and other terminologies failing to be explained can be construed according to the following purposes. Particularly, in this disclosure, 'information' in this disclosure is the terminology that generally includes values, parameters, coefficients, elements and the like and its meaning can be construed as different occasionally, by which the present invention is non-limited.

FIG. 1 is a diagram of an object encoder according to one embodiment of the present invention;

Referring to FIG. 1A, an object encoder 100 according to one embodiment of the present invention receives a plurality of object signals (object 1 to object 4) and then generates a mono or stereo downmix signal (DMX).

FIG. 1B shows an object encoder 100A in case that a plurality of object signals include vocal, piano, violin and cello signals, respectively. FIG. 1C shows an object encoder 100B in case that two object signals (piano_L and piano_R) among a plurality of object signals correspond to a stereo object signal.

Referring to FIG. 1C, the object encoder 100B receives a plurality of object signals (vocal, piano_L, piano_R and cello) and then generates a bitstream. In this case, the bitstream includes a relation identifier indicating whether the two object signals (piano_L and piano_R) among a plurality of the object signals are related to each other and downmix channel level difference (DCLD) indicating a gain difference between objects distributed to left and right channels if the downmix signal is a stereo downmix signal.

Meanwhile, the bitstream is able to further include object information indicating attributes of the objects. The object information includes object level information indicating a level of object and object gain information (DMG) indicating a gain applied to the object in case of generating the downmix signal In case that a downmix signal is mono, downmix gain information can include a gain itself applied to a mono channel of a specific object. In case that a downmix is stereo, downmix gain information can correspond to a sum of a gain for a left channel of a specific object and a gain for a right channel thereof. The aforesaid downmix level difference information can correspond to a ratio of a gain corresponding to a left channel to a gain corresponding to a right channel.

Figure 2:
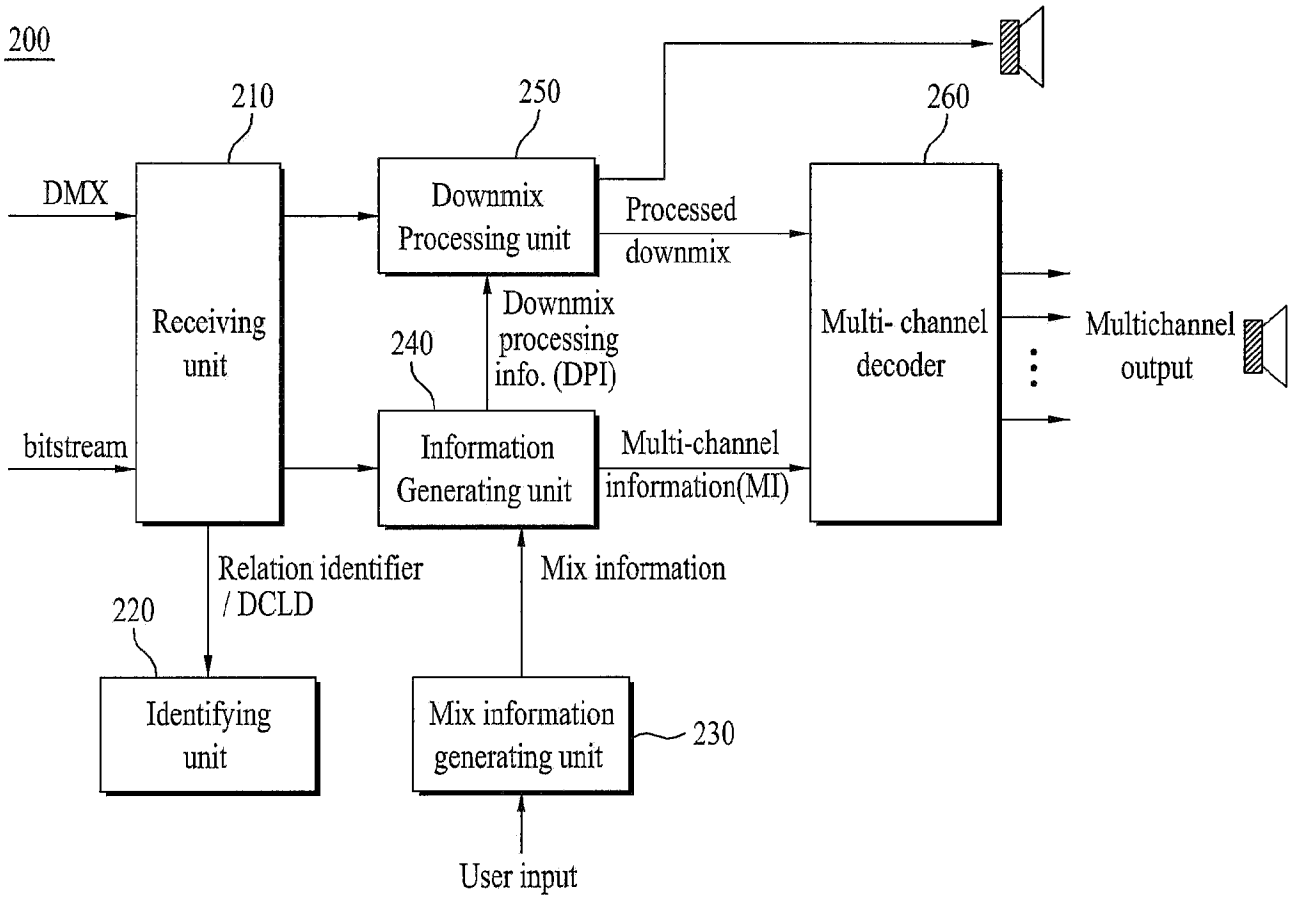
FIG. 2 is a block diagram of an audio signal processing apparatus according to the present invention.

FIG. 2 is a block diagram of an audio signal processing apparatus according to the present invention.

Referring to FIG. 2, an audio processing apparatus 200 according to the present invention includes a receiving unit 210, an identifying unit 220, a mix information generating unit 230, an information generating unit 240, a downmix processing unit 250 and a multichannel decoder 260.

The receiving unit 210 receives a downmix signal including at least one object and a bitstream including a relation identifier and downmix channel level difference information from the object encoder 100/100A/100B.

In the drawing, shown is that the downmix signal is received separate from the bitstream. This is provided to help the understanding of the present invention. And, the downmix signal can be transmitted by being included in one bitstream.

In case that the received downmix signal includes at least two object signals, the receiving unit 210 extracts the relation identifier and the downmix channel level difference information from the bitstream and then outputs them to the identifying unit 220.

The relation identifier indicates whether two of the at least two object signals included in the downmix signal are related to each other.

The identifying unit 220 identifies whether the two object signals included in the downmix signal are represented as a stereo object signal, and more particularly, whether the two object signals correspond to the stereo object signal.

Since the relation identifier (bsrelatedTo[i][j]) may correspond to information indicating whether a relation exists between an $i^{th}$ object and a $j^{th}$ object, it is extracted if at least two objects exist. Moreover, for instance, the relation identifier may include information corresponding to 1 bit. Therefore, if the relation identifier is set to 1, it indicates that the two object signals are related to each other. If the relation identifier is set to 0, it may indicate that the two object signals are not related to each other.

The following table shows an example of transmitting a relation identifier if there are total 5 objects and $2^{nd}$ object (i=1) and $3^{rd}$ objects (j=2) are related to each other.

TABLE 1

Example of Relation Identifier

| bsrelatedTo[i][j] | i = 0 | i = 1 | i = 2 | i = 3 | i = 4 |
|---|---|---|---|---|---|
| j = 0 | — | — | — | — | — |
| j = 1 | 0 | — | — | — | — |
| j = 2 | 0 | 1 | — | — | — |
| j = 3 | 0 | 0 | 0 | — | — |
| j = 4 | 0 | 0 | 0 | 0 | — |

In Table 1, 'i' and 'j' indicate object indexes, respectively.

Referring to Table 1, it is able to transmit relation identifier having 'i' set to 0~4 and 'j' set to (i+1)~4. Since relation identifiers having 'i' set to 0~4 and 'j' set to 0~i are redundant, they are excluded.

The stereo object signal is the object signal including a left object signal and a right object signal. In particular, the left object signal is mapped to a left channel. And, the right object signal is mapped to a right channel.

For instance, in case that a downmix signal is the signal constructed with 2 channels including an object signal A and an object signal B (e.g., 'A' indicates piano_L and 'B' may indicate piano_R.), the objects A and B of the stereo object signals can be mapped to the left channel and the right channel, respectively. Therefore, since the object signal A is mostly mapped to the left channel, a downmix channel level difference for the object signal A can have a maximum value (e.g., 150 dB). Since the object signal B is mostly mapped to the right channel, a downmix channel level difference for the object signal B can have a minimum value (e.g., −150 dB). (Of course, on the contrary, according to the definition of DCLD, DCLD of the object signal A has a minimum value and DCLD of the object signal B can have a maximum value).

Using this property, a decoder is able to determine whether this object is a part (i.e., left channel or right channel) of a stereo object, based on the transmitted DCLD value. In particular, if a downmix channel level difference each of two related objects (forming a pair) has a maximum value (e.g., +150 dB) or a minimum value (2.g., −150 dB), it is able to identify whether the two object signals correspond to stereo object signal (left object or right object). Moreover, it is able to identify that an object having a downmix channel level difference set to a maximum value is a left object of the stereo objects and that an object having a downmix channel level difference set to a minimum value is a right object of the stereo objects (and vice versa, as mentioned in the foregoing description, according to the definition of the DCLD).

In case that at least two object signals are represented as stereo object signals, the mix information generating unit 230 receives a single user input for both a left object and a right object and then generates mix information including a first element and a second element using the single user input. In the following description, a single user input for a left object and a right object both is explained in detail. First of all, as the left and right objects in the stereo objects are handled as independent objects, respectively, although it is able to display an interface for adjusting the left and right objects separately (cf. FIG. 5), it is unable to adjust both of the left and right objects simultaneously. Instead, either the left object or the right object can be adjusted only. In particular, in case that there is a user input for a left object, a user input for a right object is automatically determined. On the contrary, if a user input for a right object exists, a user is unable to input a user input for a left object. Since a sound quality is considerably distorted in adjusting a level (and panning) of each of the left and right objects due to the stereo object properties, this is the means for adjusting the left and right objects collectively.

Meanwhile, the first and second elements are used in controlling the stereo object signal.

On the contrary, in case that at least two object signals fail to correspond to stereo object signals, the mix information generating unit 230 receives a user input for each of the object signals and then generates mix information using the user inputs.

Meanwhile, the mix information is the information generated based on object position information, object gain information, playback configuration information and the like. In particular, the object position information is the information inputted by a user to control a position or panning of each object. And, the object gain information is the information inputted by a user to control a gain of each object. And, the playback configuration information is the information including the number of speakers, positions of speakers, ambient information (virtual positions of speakers) and the like. The playback configuration information is inputted by a user, is stored in advance, or can be received from another device.

Meanwhile, referring to FIG. 2, the mix information is inputted by a user for example, by which the present invention is non-limited. Alternatively, the mix information includes the information inputted to the information generating unit 240 by being included in a bitstream or can include the information that is inputted externally and separately.

Meanwhile, the information generating unit 260 is able to generate at least one of downmix processing information and multichannel information based on the bitstream received from the receiving unit 210 and the mix information received from the mix information generating unit 230.

The information generating unit 240 is able to generate downmix processing information for pre-processing the downmix signal using the mix information and the bitstream.

Subsequently, the downmix processing information is inputted to the downmix processing unit 250 and then changes a channel carrying the object included in the downmix signal, whereby panning is performed or a gain of the object is adjusted.

For instance, if the downmix signal is stereo, i.e., if an object signal exists on a left channel and a right channel both, it is able to perform panning or adjust an object gain. If the object signal exists on either the left channel or the right channel, it is able to locate the object signal at an opposite position.

Meanwhile, if the downmix signal is mono, it is able to adjust an object gain.

The downmix processing unit 250 receives the downmix signal from the receiving unit 210 and also receives the downmix processing information from the information generating unit 240. The downmix processing unit 250 is able to interpret it as a subband domain signal using a subband interpreting filter bank. The downmix processing unit 250 is able to generate a processed downmix signal using the downmix signal and the downmix processing information. In doing so, in order to control an object panning and an object gain, it is able to pre-process the downmix signal.

Meanwhile, if the number of final output channels of the audio signal is greater than that of channels of the downmix signal, the information generating unit 240 is able to further generate multichannel information for upmixing the downmix signal using the bitstream received from the receiving unit 210 and the mix information received from the mix information generating unit 230.

In this case, the multichannel information can include channel level information, channel correlation information and channel prediction coefficient.

The multichannel information is outputted to the multichannel decoder 260. Subsequently, the multichannel decoder 260 is able to finally generate a multichannel signal by performing upmixing using the processed downmix signal and the multichannel information.

Meanwhile, the processed downmix signal can be directly outputted via a speaker. For this, the downmix processing unit 250 is able to output a PCM signal in time domain by performing synthetic filter bank using the processed subband domain signal.

Figure 3:
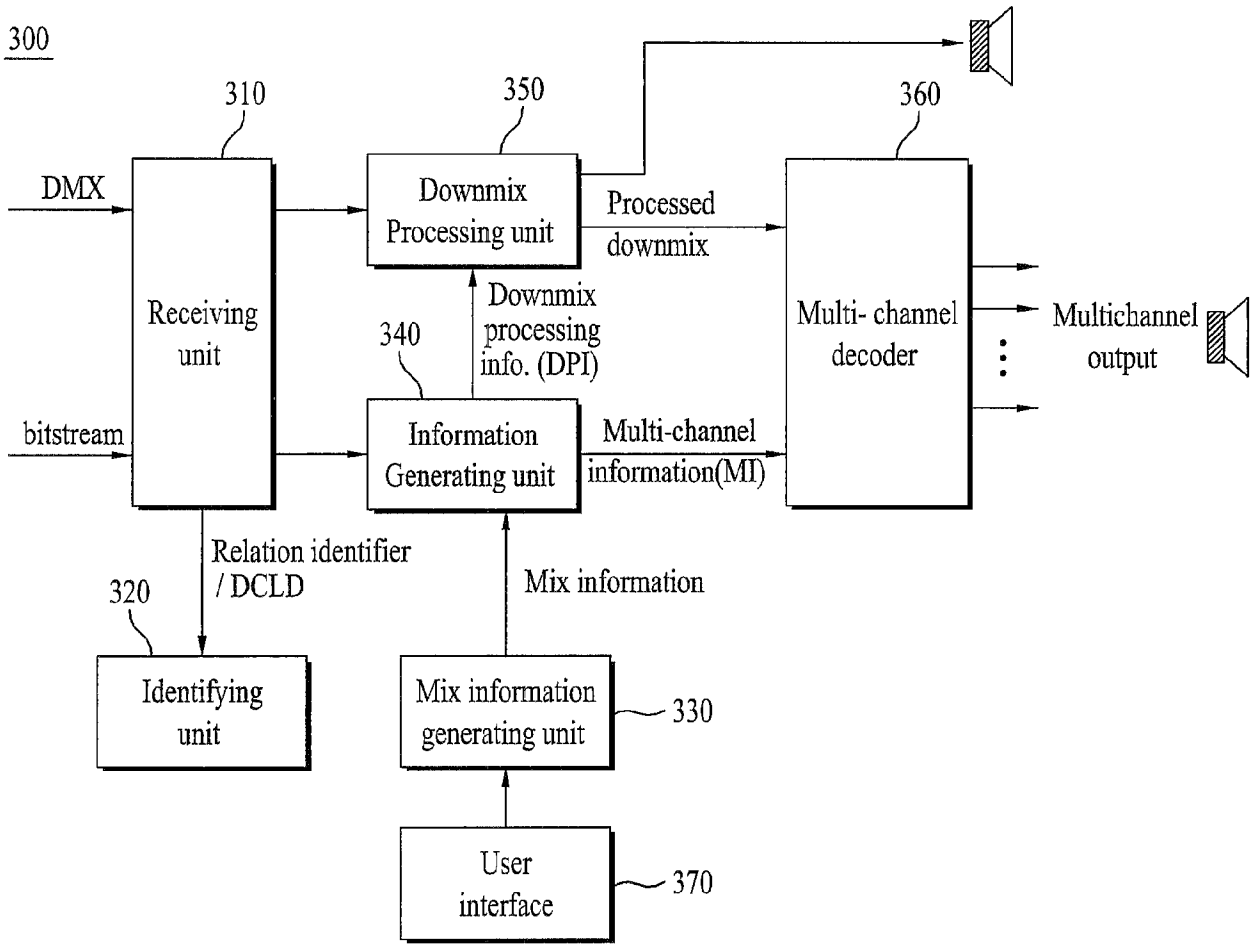
FIG. 3 is a block diagram of an audio signal processing apparatus with a user interface according to an embodiment of the present invention.

FIG. 3 is a block diagram of an audio signal processing apparatus with a user interface according to an embodiment of the present invention.

Referring to FIG. 3, an audio processing apparatus 300 according to the present invention includes a receiving unit 310, an identifying unit 320, a mix information generating unit 330, an information generating unit 340, a downmix processing unit 350, a multichannel decoder 360 and a user interface 370.

The functions and configurations of the receiving unit 310, the identifying unit 320, the mix information generating unit 330, the information generating unit 340, the downmix processing unit 350 and the multichannel decoder 360 in FIG. 3 are equal to those of the receiving unit 210, the identifying unit 220, the mix information generating unit 230, the information generating unit 240, the downmix processing unit 250 and the multichannel decoder 260 in FIG. 2, of which details are omitted from the following description.

And, the user interface 370 receives a user input for adjusting a level of at least one object. The user input is inputted to the mix information generating unit 330 and mix information estimated by the user input is then outputted.

Figure 4:
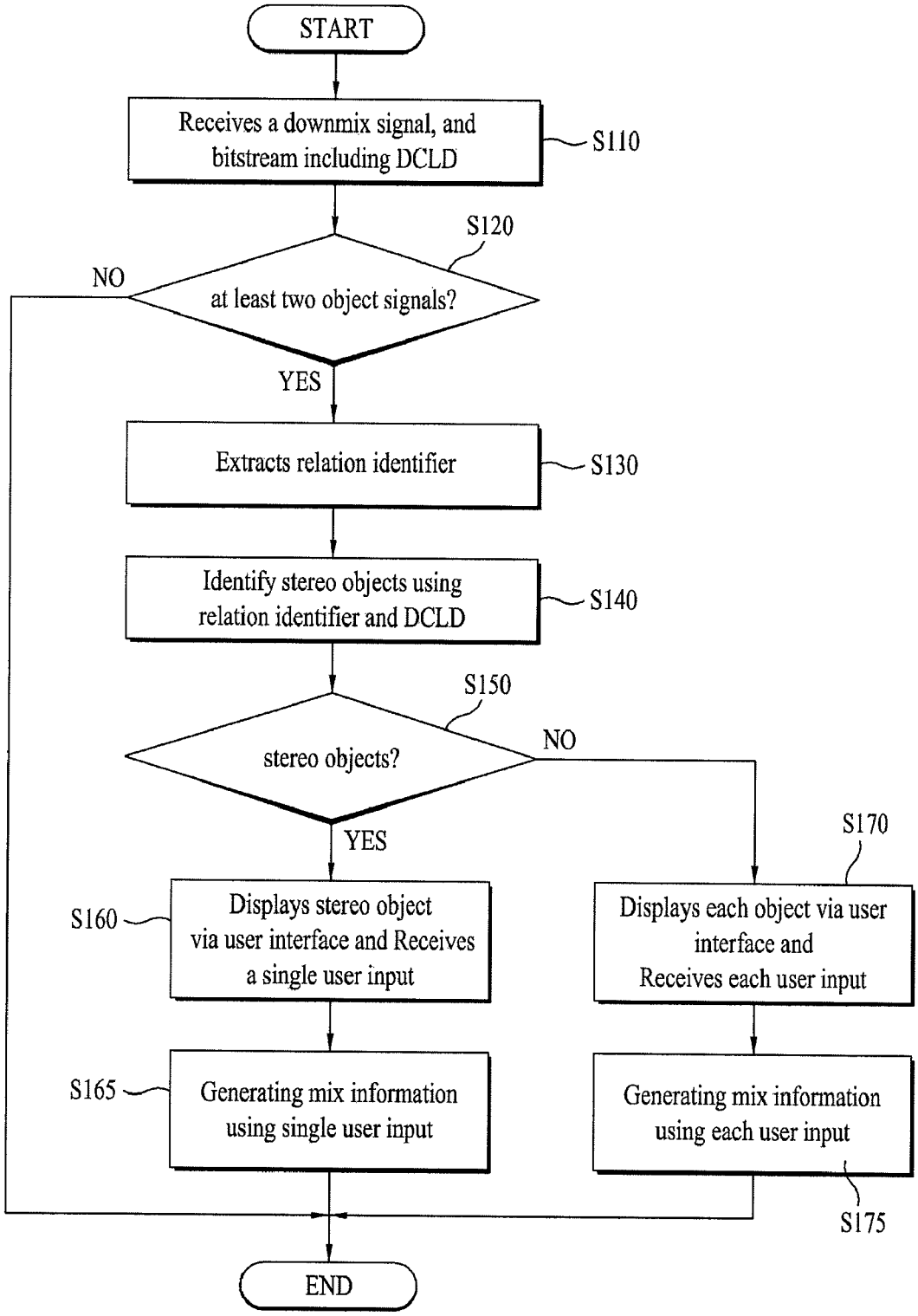
FIG. 4 is a flowchart for a method of processing an audio signal according to one embodiment of the present invention.

FIG. 4 is a flowchart for a method of processing an audio signal according to one embodiment of the present invention.

Referring to FIG. 4, an audio signal processing method according to one embodiment of the present invention includes the following steps.

First of all, a bitstream, which includes a downmix signal, a relation identifier and a DCLD, is received [S110].

Subsequently, it is checked whether the downmix signal includes at least two object signals [S120]. If the downmix signal includes at least two object signals, the relation identifier is obtained from the received bitstream [S130].

Using the relation identifier and the DCLD, it is identified whether the two of at least two or more object signals correspond to a stereo object signal [S140].

If the two of at least two or more object signals correspond to a stereo object signal in the step S140, stereo objects are displayed via a user interface and a single user input for the stereo object signal is then received [S160]. Subsequently, mix information is generated using the single user input [S165].

On the contrary, if the two of at least two or more object signals do not correspond to a stereo object signal in the step S140, each object is displayed via the user interface and each user input for the stereo object signal is received [S170]. Mix information is then generated using the each user input [S175].

Figure 5:
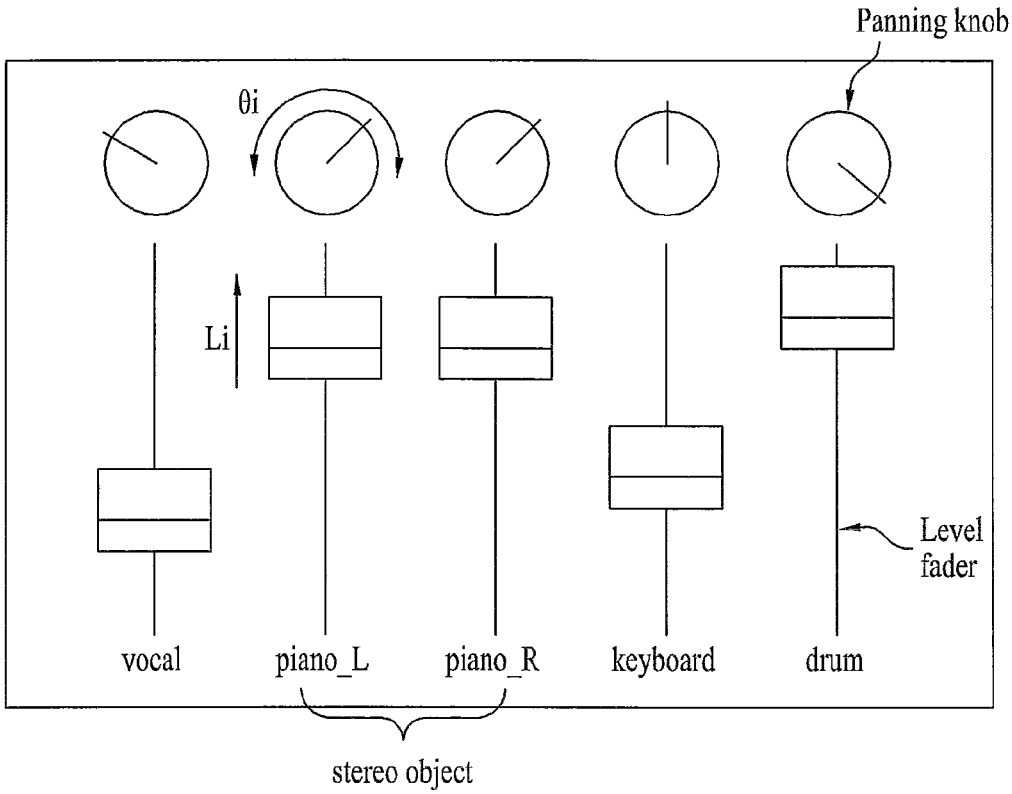
FIG. 5 is a diagram for a method of displaying a user input using a user interface according to one embodiment of the present invention.

FIG. 5 is a diagram for a method of displaying a user input using a user interface according to one embodiment of the present invention.

Referring to FIG. 5, a user interface can include panning knobs for adjusting pannings of objects including stereo objects and level faders for adjusting gains of the objects.

As mentioned in the foregoing description with reference to FIG. 2 and FIG. 3, stereo objects (e.g., piano_L and piano_R) can be included in objects. As mentioned in the foregoing description, if a user adjusts a level fader (and a panning knob) for one (left or right object) of the stereo objects, a level (and a panning) for the other object is automatically determined. Therefore, it is able to display that a level fader (and a panning knob) for the other object is moving automatically.

The level and/or panning of the adjusted object, to which the mix information generated using the user input inputted via the user interface is applied, can be displayed on the user interface together with metadata indicating features of the object.

Figure 6:
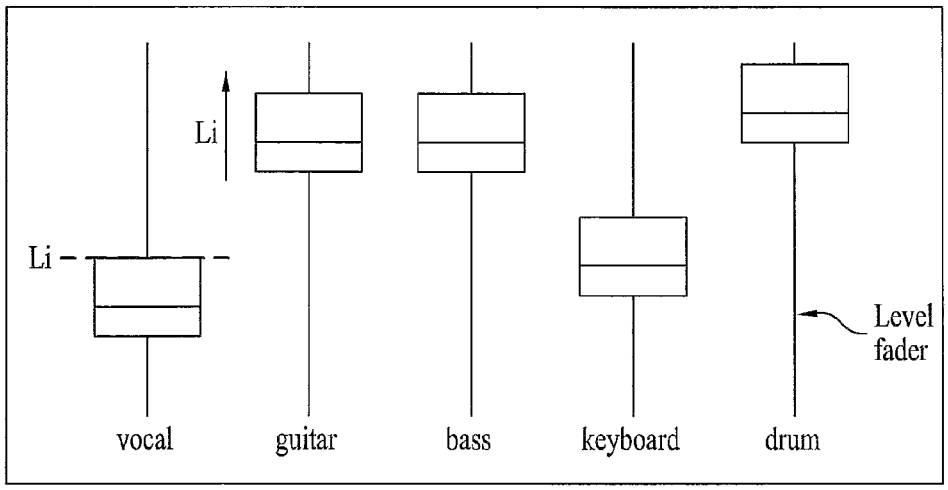
FIG. 6 is a diagram for an object adjusting method using a user interface according to one embodiment of the present invention in case of a mono output.
Figure 6:
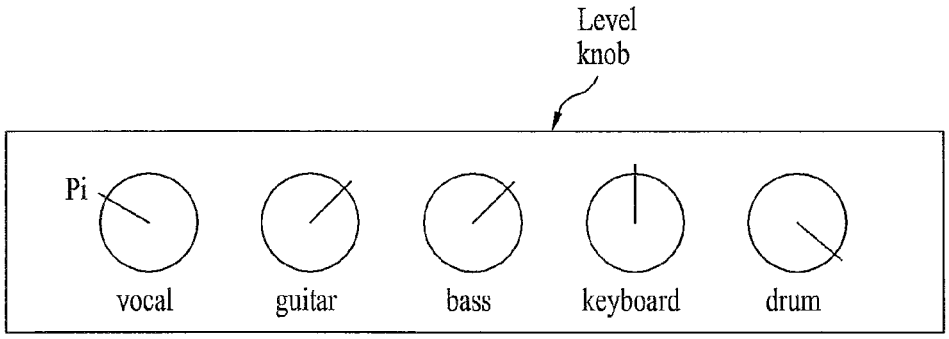

FIG. 6 is a diagram for an object adjusting method using a user interface according to one embodiment of the present invention in case of a mono output. In case that an output is mono, since a panning knob for adjusting a panning of an object is unnecessary, it is necessary to adjust a level of the object only.

FIG. 6A shows that a level of an object is adjusted by shifting a level fader up and down using the level fader. FIG. 6B shows that a level of an object is adjusted by rotating a level knob using the level knob. Moreover, it is able to implement the level fader, as shown in FIG. 6A, to move up and down (or on a straight line). Alternatively, the level fader can move on a curve line or can be rotatably implemented.

In FIG. 6A, assume that a parameter from a level fader for a vocal object is Li, that a parameter from a panning knob is Pi, and that the parameters are given by dB scale.

In this case, in case of a mono output, mix information generated by the mix information generating unit 330 can be determined as Formula 1 or Formula 2.

$$M_{mono} = \lfloor m_{0,M} \quad \Lambda \quad m_{N-1,M} \rfloor \qquad \text{[Formula 1]}$$

$$M_{mono} = \begin{bmatrix} 0 & \Lambda & 0 \\ 0 & \Lambda & 0 \\ m_{0,M} & \Lambda & m_{n-1,M} \\ 0 & \Lambda & 0 \\ 0 & \Lambda & 0 \\ 0 & \Lambda & 0 \end{bmatrix} \qquad \text{[Formula 2]}$$

In this case, 'N−1 ' in $m_{N-1,M}$ indicates an object. Hence, in Formula 1 and Formula 2, a mono output includes N objects (where N is set to 0, . . . , N−1). Moreover, in Formula 2, parameters exist in a $3^{rd}$ row of a matrix corresponding to a center channel and no parameter exists in the rest of the rows of the matrix. Hence, in the same case of Formula 1, mix information in case of a mono output is indicated. And, mix information $m_{i,M}$ is obtained from Formula 3.

$$m_{i,M} = 10^{0.05 \cdot L_i} \qquad \text{[Formula 3]}$$

In order to generate a multichannel signal from a downmix signal including at least one object, initialized mix information should be specified. This information can be inputted by a user. Alternatively, this information is provided by preset information indicating various modes selectable by a user according to characteristics or listening environment of an audio signal or can be provided by default setting.

Figure 7:
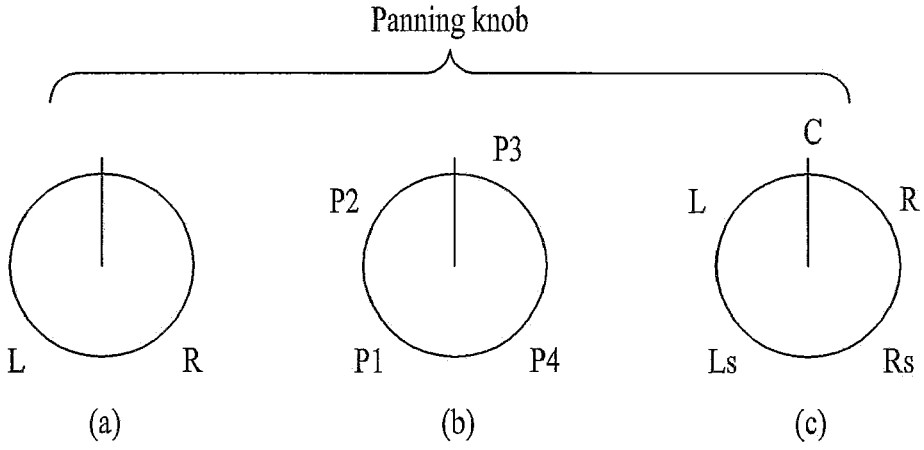
FIG. 7 is a diagram for a method of displaying a user input using a user interface according to one embodiment of the present invention, in case of: (a) stereo; (b) binaural; and (c) multichannel output.

FIG. 7 is a diagram for a method of displaying a user input using a user interface according to one embodiment of the present invention, in case of: (a) stereo; (b) binaural; and (c) multichannel output.

FIG. 7A shows a panning knob for adjusting a panning of an object in case of a stereo output. In case of a stereo output, mix information in a format of a matrix, which is generated by the mix information generating unit 330, is determined according to Formula 4 or Formula 5.

$$M_{stereo} = \begin{bmatrix} m_{0,L} & \Lambda & m_{N-1,L} \\ m_{0,R} & \Lambda & m_{N-1,R} \end{bmatrix} \qquad \text{[Formula 4]}$$

$$M_{stereo} = \begin{bmatrix} m_{0,L} & \Lambda & m_{N-1,L} \\ m_{0,R} & \Lambda & m_{N-1,R} \\ 0 & \Lambda & 0 \\ 0 & \Lambda & 0 \\ 0 & \Lambda & 0 \\ 0 & \Lambda & 0 \end{bmatrix} \qquad \text{[Formula 5]}$$

In this case, 'N−1 ' indicates an object and 'L' and 'R' indicate channels, respectively.

Moreover, mix information $m_{i,L}$ and mix information $m_{i,R}$ can be obtained from Formula 6.

$$m_{i,L} = 10^{0.05 \cdot L_i} \sqrt{\frac{10^{0.1 \cdot P_i}}{1 + 10^{0.1 \cdot P_i}}} \qquad \text{[Formula 6]}$$

$$m_{i,R} = 10^{0.05 \cdot L_i} \sqrt{\frac{1}{1 + 10^{0.1 \cdot P_i}}}$$

The case of a binaural output is similar to the case of the stereo output but differs in interpretation of the panning knob only. Referring to FIG. 7B, in case of the binaural output, an indicator displayed around the panning knob is able to include another direction corresponding to HRTF dB. In FIG. 7B, assume that the HRTF includes 4 different positions P1 to P4.

In case of the binaural output, mix information can be represented as L×N having the number of virtual positions set to L, as shown in Formula 7.

$$M_{binaural} = \begin{bmatrix} m_{0,VP_0} & \Lambda & m_{N-1,VP_0} \\ m_{0,VP_1} & \Lambda & m_{N-1,VP1} \\ M & O & M \\ m_{0,VP_{L-1}} & \Lambda & m_{N-1,VP_{L-1}} \end{bmatrix} \qquad \text{[Formula 7]}$$

Meanwhile, each value included in the matrix can be found by Formula 8 as follows.

$$m_{i,VP_i} = 10^{0.05 \cdot L_i} \sqrt{\frac{10^{0.1 \cdot \hat{P}_i}}{1 + 10^{0.1 \cdot \hat{P}_i}}} \qquad \text{[Formula 8]}$$

-continued $$m_{i,VP_{i+1}} = 10^{0.05 \cdot L_i} \sqrt{\frac{1}{1 + 10^{0.1 \cdot \hat{P}_i}}},$$

$$\text{for } VP_i < P_i \le VP_{i+1},$$

$$m_{i,rest} = 0, \text{ and}$$

$$\hat{P}_i = P_i - \frac{VP_i + VP_{i+1}}{2},$$

In this case, $VP_i$ indicates a preset panning value at an $i^{th}$ virtual position.

Referring to FIG. 7C, the case of multichannel output is similar to the case of the binaural output shown in FIG. 7B except that preset positions correspond to 5.1 channel.

As conjectured through FIG. 7C, in case of the multichannel output, a user intends to place one object at one spatial position.

Yet, if it is intended to perform rendering to enable a prescribed object (e.g., applaud, background noise, etc.) to be played through all speakers, it is impossible to perform the rendering using the user interface shown in FIG. 7C.

For instance, in case of the stereo output, a prescribed object can be played via al speakers in a manner that a panning knob is set at a center position. Yet, in case of the multichannel output, it is impossible to play a prescribed object via all speakers using the panning knob only.

In case of the multichannel output, mix information can have such a matrix type as shown in Formula 9.

[Formula 9]

$$M_{multichannel} = \begin{bmatrix} m_{0,Lf} & \Lambda & m_{N-1,Lf} \\ m_{0,Rf} & \Lambda & m_{N-1,Rf} \\ m_{0,C} & \Lambda & m_{N-1,C} \\ m_{0,Lfe} & \Lambda & m_{N-1,Lfe} \\ m_{0,Ls} & \Lambda & m_{N-1,Ls} \\ m_{0,Rs} & \Lambda & m_{N-1,Rs} \end{bmatrix}$$

In this matrix, each row indicates an output channel and each column indicates an object. Hence, an output signal via the matrix includes N objects and also include 6 channels (Lf, Rf, C, Lfe, Ls, Rs) of 5.1-channel Meanwhile, each value included in the matrix can be found by Formula 10 as follows.

[Formula 10]

$$m_{i,y} = 10^{0.05 \cdot L_i} \sqrt{\frac{10^{0.1 \cdot \hat{P}_i}}{1 + 10^{0.1 \cdot \hat{P}_i}}}$$

$$m_{i,z} = 10^{0.05 \cdot L_i} \sqrt{\frac{1}{1 + 10^{0.1 \cdot \hat{P}_i}}}, \text{ for } P_y < P_i \le P_z,$$

$$m_{i,rest} = 0, \text{ and}$$

$$\hat{P}_i = P_i - \frac{P_y + P_z}{2},$$

where 'y' and 'z' indicate adjacent channels, respectively.

For instance, assume that $P_c$, $P_{Lf}$, $P_{Rf}$, $P_{Ls}$ and $P_{Rs}$ are set to 0 dB, −10 dB, 10 dB, −20 dB and 20 dB, respectively. Assume that a user inputted panning value for an $i^{th}$ object is set to 15 dB. If the above values are inserted in Formula 10, Formula 11 is generated.

[Formula 11]

$$m_{i,Rf} = 10^{0.05 \cdot L_i} \sqrt{\frac{1}{2}}$$

$$m_{i,Rs} = 10^{0.05 \cdot L_i} \sqrt{\frac{1}{2}}$$

$$m_{i,rest} = 0$$

Therefore, through Formula 11, it can be observed that a user intended to perform rendering on an $i^{th}$ object between a right front speaker and a right surround speaker.

A user is able to adjust objects one by one. Yet, in case that stereo objects (piano_L, Piano_R) are included, as shown in FIG. 5, levels and pannings of the two objects should be jointly adjusted.

A left channel of stereo objects can be mixed into a right channel of a downmix signal in an encoding step. And, a left channel of stereo objects can be cross-rendered into a right channel of a processed output downmix signal. Yet, since channels of stereo objects share the same attribution with each other, it is preferable that cross-rendering is limited in most of applications.

In this case, if an $i^{th}$ object is a right channel object, rendering parameters $M_{i,Lf}$ and $M_{i,Ls}$ are always set to zero. If a $j^{th}$ object is a left channel object, rendering parameters $M_{j,Rf}$ and $M_{j,Rs}$ are always set to zero.

In the stereo objects shown in FIG. 5, assume that a level of an object piano_L is adjusted by $L_i$ in dB scale. And, assume that a panning of an object piano_L is adjusted by $\theta_i$. In this case, it is able to perform mapping on the $L_i$ and the $\theta_i$ by amplitude panning law.

As a result, Formula 12 is established.

[Formula 12]

$$m_{i,ch_k} = 10^{0.05 L_i} \sqrt{\frac{g_{i,ch_k}}{1 + g_{i,ch_k}}},$$

$$m_{i,ch_{k+1}} = 10^{0.05 L_i} \sqrt{\frac{1}{1 + g_{i,ch_k}}}$$

In Formula 12, $g_{i,ch_k}$ is a gain ratio between two adjacent speakers obtained from $\theta_i$.

As mentioned in the foregoing description, in case of stereo objects, it is possible to adjust a level of object using one module of a user interface, e.g., one level fader for the object piano_L shown in FIG. 5.

Considering Formula 12 and the properties of the stereo objects, mix information of a rendering matrix type for the stereo objects can be represented as Formula 13.

[Formula 13]

$$m_{i,ch_k} = 10^{0.05 L_i} \sqrt{\frac{g_{i,ch_k}}{1 + g_{i,ch_k}}}, \; m_{i,ch_{k+1}} = 0,$$

$$m_{i+1,ch_k} = 0, \; m_{i+1,ch_{k+1}} = 10^{0.05 L_i} \sqrt{\frac{1}{1 + g_{i,ch_k}}}$$

In particular, in case of stereo object signals, mix information includes a first element ($m_{i,ch_k}$) and a second element ($m_{i+1,ch_{k+1}}$). The first element is applied to a left object signal of the stereo object signals to output a first channel. And, the second element is applied to a right object signal of the stereo object signals to output a second channel.

The first and second elements are jointly used to control the stereo object signals. And, negative correlation exists between the first and second elements. Namely, if the first element increases, the second element decreases, and vice versa.

Moreover, in case of the stereo object signals, the mix information further includes a third element ($m_{i+1,ch_k}$) and a fourth element ($m_{i,ch_{k+1}}$). The third element is applied to the left object signal of the stereo object signals to output the second channel And, the fourth element is applied to the right object signal of the stereo object signals to output the first second channel And, each of the third and fourth elements is set to 0.

Meanwhile, the first channel and the second channel can correspond to a left channel and a right channel, respectively.

Figure 8:
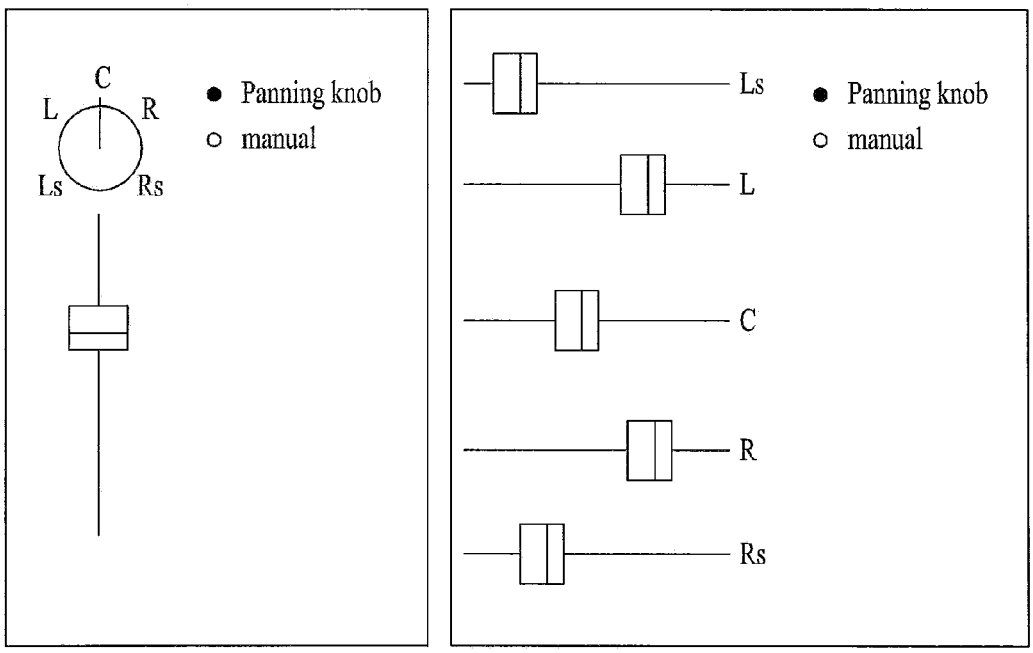
FIG. 8 is a diagram for an object adjusting method using a user interface according to one embodiment of the present invention, in which an extended mode is included within the user interface.

FIG. 8 is a diagram for an object adjusting method using a user interface according to one embodiment of the present invention, in which an extended mode is included within the user interface. FIG. 8A shows a normal mode of a user interface. And, FIG. 8B shows an extended manual mode.

Referring to FIG. 8, a user is able to select a manual part on a user interface shown in FIG. 8A. As a result, as shown in FIG. 8B, the user is able to manually select a specific rendering level in each output channel.

Figure 9:
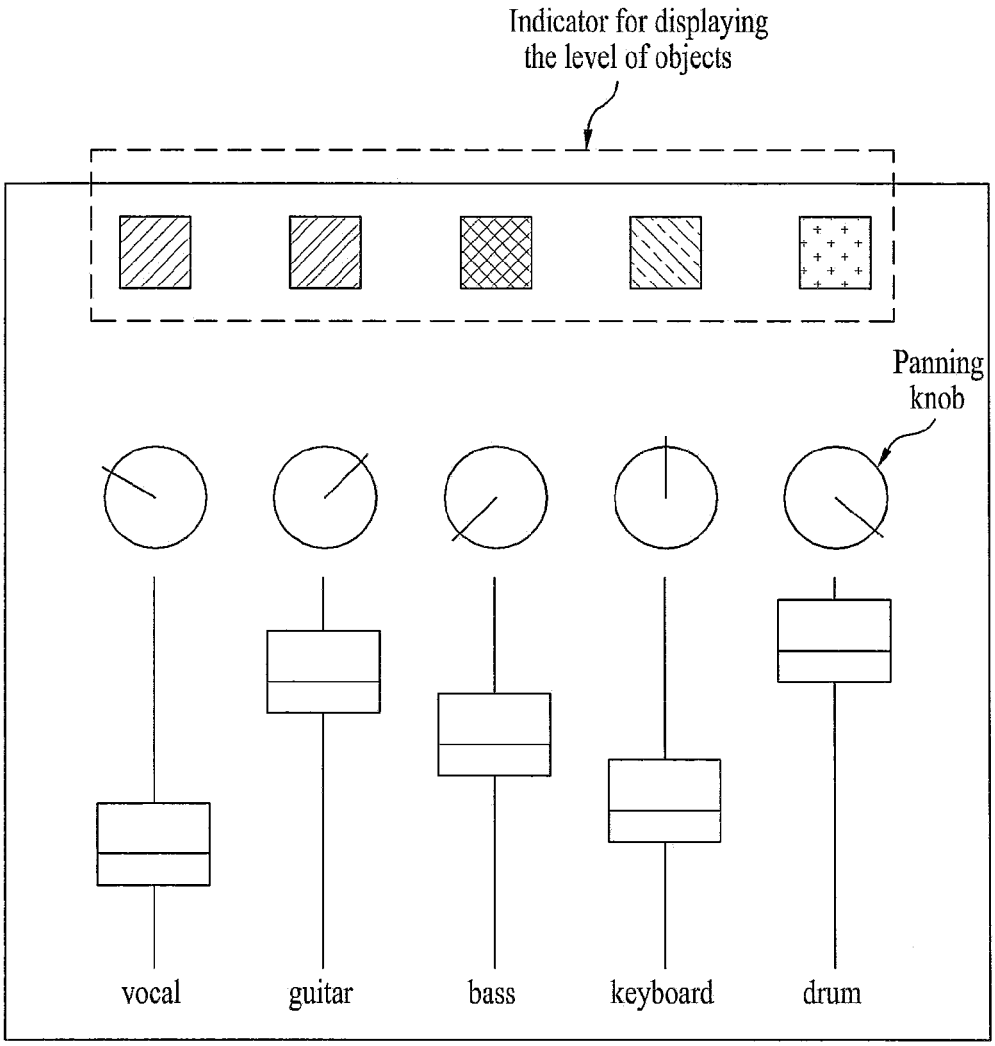
FIG. 9 is a diagram of a user interface including an indicator capable of displaying an object level according to one embodiment of the present invention.

FIG. 9 is a diagram of a user interface including an indicator capable of displaying an object level according to one embodiment of the present invention.

Referring to FIG. 9, a user interface according to one embodiment of the present invention includes an indicator provided above a panning knob to indicate an object level. In particular, the indicator is able to display an object level by changing its color. The present invention displays an object level by changing an indicator color, by which the present invention is non-limited.

Figure 10:
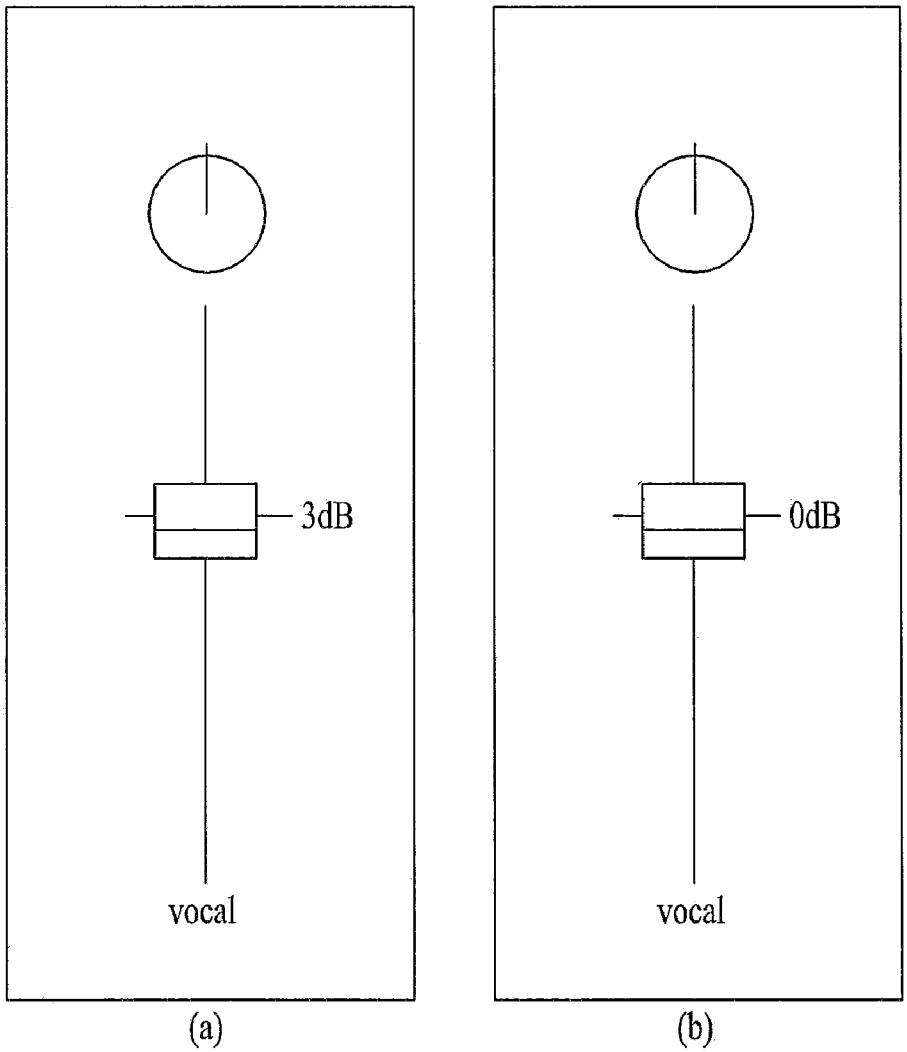
FIG. 10 is a diagram for a method of setting an initial position of a level fader in a user interface according to one embodiment of the present invention.

FIG. 10 is a diagram for a method of setting an initial position of a level fader in a user interface according to one embodiment of the present invention.

First of all it is able to set an initial position at a level fader according to object gain information (DMG) indicating a gain applied to an object in case off generating a downmix signal. FIG. 10A shows a method of setting an initial position to a middle of a level fader by reflecting a current level (e.g., 3 dB) of an object included in a downmix signal And, FIG. 10B shows a method of setting an initial position as a current level (e.g. 3 dB) of an object included in a downmix signal.

Referring to FIG. 10A and FIG. 10B, since a user is facilitated to control an object level relative to a current level, as mentioned in the foregoing description, it is able to set an initial position at a level fader according to object gain information.

In this case, a rendering parameter can be calculated by reflecting a current level of an object, as shown in Formula 14.

$$\hat{m}_{i,ch}=10^{0.05\cdot DMG_i}\cdot m_{i,ch} \quad \text{[Formula 14]}$$

Meanwhile, in case that a downmix signal is a stereo downmix signal, it is able to set an initial position at a panning knob according to downmix channel level difference (DCLD) information indicating a gain difference between objects distributed to left and right channels.

Figure 11:
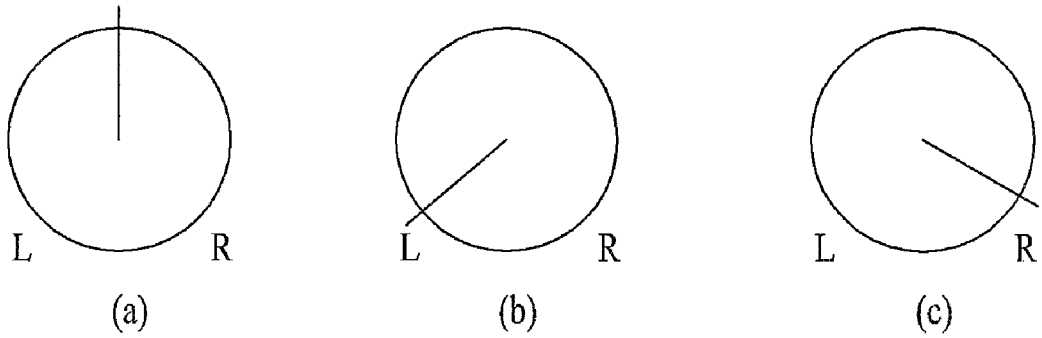
FIG. 11 is a diagram for a method of setting an initial position of a panning knob in a user interface according to one embodiment of the present invention.

FIG. 11 is a diagram for a method of setting an initial position of a panning knob in a user interface according to one embodiment of the present invention.

First of all, if a downmix channel level difference (DCLD) is set to 0 dB, referring to FIG. 11A, it is able to set an initial position of a panning knob at a neutral position. If DCLD is set to a maximum value (e.g., 150 dB) or a minimum value (e.g., −150 dB), it is able to set the initial position at a left (or right) end position.

Figure 12:
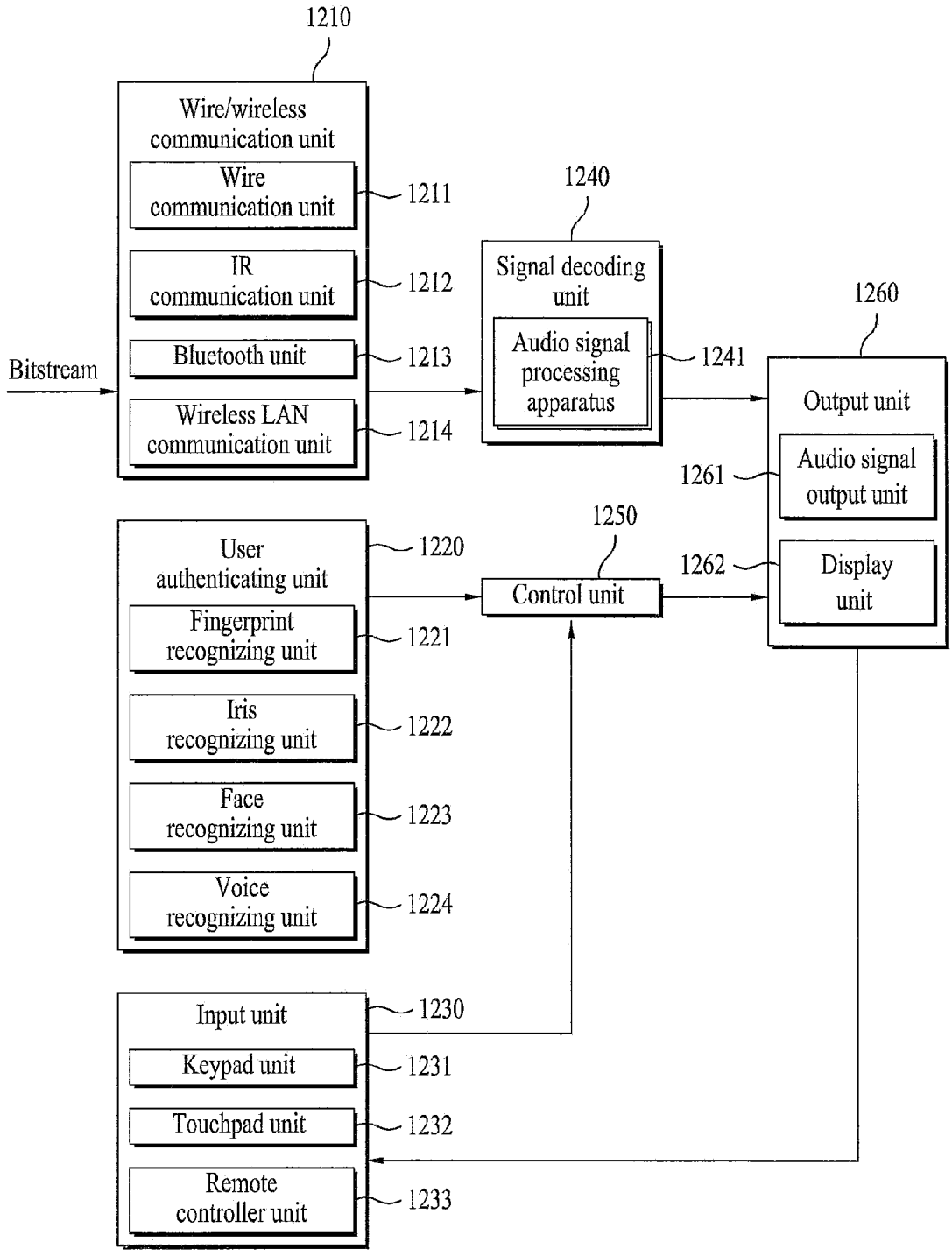
FIG. 12 is a schematic block diagram of a product in which an audio signal processing apparatus according to one embodiment of the present invention is implemented.
Figure 13:
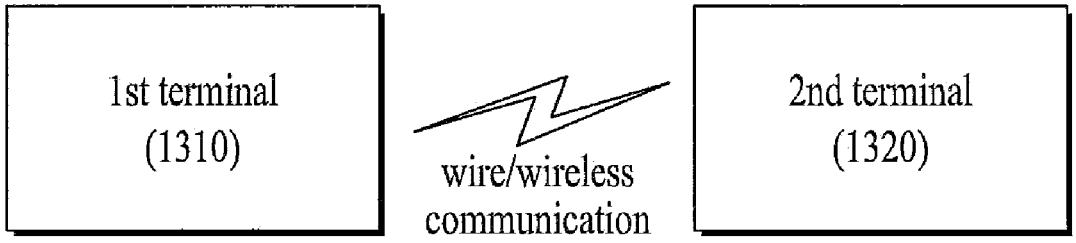
FIG. 13A and FIG. 13B are diagrams for relations of products each of which is provided with an audio signal processing apparatus according to one embodiment of the present invention.
Figure 13:
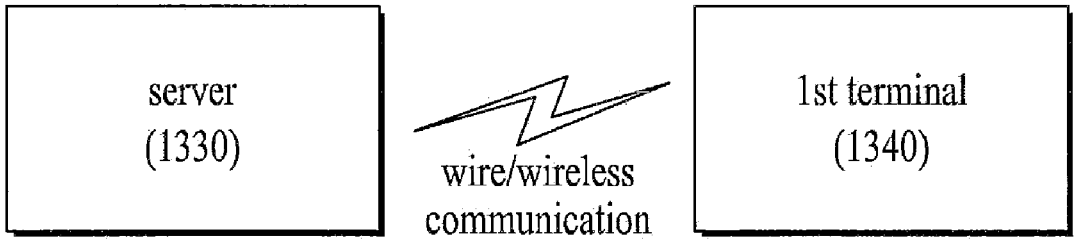

FIG. 12 is a schematic block diagram of a product in which an audio signal processing apparatus according to one embodiment of the present invention is implemented. And, FIG. 13A and FIG. 13B are diagrams for relations of products each of which is provided with an audio signal processing apparatus according to one embodiment of the present invention.

Referring to FIG. 12, a wire/wireless communication unit 1210 receives a bitstream via wire/wireless communication system. In particular, the wire/wireless communication unit 1210 can include at least one of a wire communication unit 1211, an infrared unit 1212, a Bluetooth unit 1213 and a wireless LAN unit 1214.

A user authenticating unit 1220 receives an input of user information and then performs user authentication. The user authenticating unit 1220 can include at least one of a fingerprint recognizing unit 1221A, an iris recognizing unit 1222, a face recognizing unit 1223 and a voice recognizing unit 1224. The fingerprint recognizing unit 1221, the iris recognizing unit 1222, the face recognizing unit 1223 and the voice recognizing unit 1224 receive fingerprint information, iris information, face contour information and voice information and then convert them into user informations, respectively. Whether each of the user informations matches pre-registered user data is determined to perform the user authentication.

An input unit 1230 is an input device enabling a user to input various kinds of commands and can include at least one of a keypad unit 1231, a touchpad unit 1232 and a remote controller unit 1233, by which the present invention is non-limited.

Meanwhile, in case that an audio signal processing apparatus 1241 generates mix information, when the mix information is displayed on a screen via a display unit 1262, a user is able to adjust the mix information through the input unit 1230. The corresponding information is inputted to a control unit 1250.

A signal decoding unit 1240 includes the audio signal processing apparatus 1241. The signal decoding unit 1240 determines whether two object signals correspond to stereo object signals using a relation identifier and DCLD included in a received bitstream. As a result of the determination, if the two object signals correspond to the stereo object signals, the audio signal processing apparatus 1241 generates mix information using a single user input and then generates at least one of downmix processing information and multichannel information based on the generated mix information and object information included in the bitstream.

The control unit 1250 receives input signals from input devices and controls all processes of the signal decoding unit 1240 and an output unit 1260.

In particular, the output unit 1260 is an element configured to output an output signal generated by the signal decoding unit 1240 and the like and can include a speaker unit 1261 and a display unit 1262. If the output signal is an audio signal, it is outputted via the speaker unit 1261. If the output signal is a video signal, it is outputted via the display unit 1262.

FIG. 13A and FIG. 13B are diagrams for relations of products each of which is provided with an audio signal processing apparatus according to one embodiment of the present invention. Referring to FIG. 13A, it can be observed that a first terminal 1310 and a second terminal 1320 can exchange data or bitstreams bi-directionally with each other via the wire/wireless communication units. The data or bitstreams exchanged via the wire/wireless communication units may include the bitstreams generated by the present invention shown in FIG. 1 or the data including the relation identifier, the DCLD and the like of the present invention described with reference to FIGS. 1 to 12. Referring to FIG. 13B, it can be observed that a server 1330 and a first terminal 1340 can perform wire/wireless communication with each other as well.

Accordingly, the present invention is applicable to audio signal encoding/decoding.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. A method for processing an audio signal, comprising:

receiving a downmix signal comprising at least one object signal, and a bitstream including object information and downmix channel level difference;

when the downmix signal comprises at least two object signals, extracting a relation identifier from the bitstream, the relation identifier indicating whether two object signals among the at least two object signals are related to each other;

identifying whether the two object signals correspond to stereo object signals, using the downmix channel level difference and the relation identifier;

generating mix information including a first element and a second element using a single user input; and generating at least one of downmix processing information and multi-channel information based on the object information and the mix information, wherein:

the stereo object signals include a left object signal and a right object signal, the first element is applied to the left object signal of the stereo object signals to output a first channel, the second element is applied to the right object signal of the stereo object signals to output a second channel, and the first element is conversely related to the second element.

2. The method of claim 1, wherein the left object signal is mapped to a left channel of the downmix signal, and the right object signal is mapped to a right channel of the downmix signal.

3. The method of claim 1, wherein the identifying step comprises:

identifying whether two object signals among the at least two object signals are related to each other, based on the relation identifier;

when two object signals are related to each other, identifying whether the downmix channel level difference of the two object signals has a maximum value or a minimum value; and when the downmix channel level difference of the two object signals has a maximum or a minimum value, deciding that the two object signals correspond to the stereo object signals.

4. The method of claim 1, wherein the first element and the second element are used to control the stereo object signals jointly.

5. The method of claim 1, wherein when the first element is larger, the second element is smaller, or when the first element is smaller, the second element is larger.

6. The method of claim 1, wherein the mix information further includes a third element and a fourth element, the third element is applied to the left object signal of the stereo object signals to output the second channel, and the fourth element is applied to the right object signal of the stereo object signals to output the first channel, and wherein the third element and fourth element are zero.

7. The method of claim 1, further comprising:

processing the downmix signal using the downmix processing information; and generating a multi-channel signal based on the processed downmix signal and the multi-channel information.

8. An apparatus for processing an audio signal, comprising:

a receiving unit receiving a downmix signal comprising at least one object signal, and a bitstream including object information and downmix channel level difference, when the downmix signal comprises at least two object signals, extracting a relation identifier from the bitstream, the relation identifier indicating whether two object signals among the at least two object signals are related to each other;

an identifying unit identifying whether the two object signals correspond to stereo object signals, using the downmix channel level difference and the relation identifier;

a mix information generating unit generating mix information including a first element and a second element using a single user input; and an information generating unit generating at least one of downmix processing information and multi-channel information based on the object information and the mix information, wherein:

the stereo object signals include a left object signal and a right object signal, the first element is applied to the left object signal of the stereo object signals to output a first channel, the second element is applied to the right object signal of the stereo object signal signals to output a second channel, and the first element is conversely related to the second element.

9. The apparatus of claim 8, wherein the left object signal is mapped to a left channel and the right object signal is mapped to a right channel.

10. The apparatus of claim 8, wherein the identifying unit is configured to:

identify whether two object signals among the at least two object signals are related to each other, based on the relation identifier;

when two object signals are related to each other, identify whether the downmix channel level difference of the two object signals has a maximum value or a minimum value; and when the downmix channel level difference of the two object signals has a maximum or a minimum value, decide that the two object signals correspond to the stereo object signals.

11. The apparatus of claim 8, wherein the first element and the second element are used to control the stereo object signals jointly.

12. The apparatus of claim 8, wherein when the first element is larger, the second element is smaller, or when the first element is smaller, the second element is larger.

13. The apparatus of claim 8, wherein the mix information further includes a third element and a fourth element, the third element being applied to a left object signal of the stereo object signal to output the second channel, and the fourth element being applied to a right object signal of the stereo object signal to output the first channel, and wherein the third element and fourth element are zero.

14. The apparatus of claim 8, further comprising:

a downmix processing unit processing the downmix signal using the downmix processing information; and a multi-channel decoder generating a multi-channel signal based on the processed downmix signal and the multi-channel information.

* * * * *